United States Patent [19]

Takase et al.

[11] 3,965,281

[45] June 22, 1976

[54] METHOD FOR PAVING SURFACES WITH GRANULAR, FLAKY OR POWDERY ASPHALT

[75] Inventors: Takashi Takase, Narashino; Tsunekazu Hayashi, Mitaka; Hirokazu Saitoh, Ohmiya, all of Japan

[73] Assignee: Mitsuboshi-Sangyo Co., Ltd., Tokyo, Japan

[22] Filed: Sept. 20, 1973

[21] Appl. No.: 399,135

Related U.S. Application Data

[63] Continuation-in-part of Ser. No. 151,571, June 9, 1971, Pat. No. 3,783,000.

[30] Foreign Application Priority Data

June 11, 1970 Japan ..... 45-49845
June 11, 1970 Japan ..... 45-49846
June 11, 1970 Japan ..... 45-49847

[52] U.S. Cl. ..... 427/139; 106/281 R; 404/75; 404/79; 404/80; 404/81; 404/82; 427/138; 427/189; 427/194; 427/201

[51] Int. Cl.[2] ..... E01C 5/12; B05D 5/10

[58] Field of Search ..... 117/21, 32, 168, 100 S; 106/280, 281; 404/75, 79, 80, 81, 82; 427/138, 139, 180, 189, 201, 194

[56] References Cited

UNITED STATES PATENTS

| | | | |
|---|---|---|---|
| 1,364,621 | 1/1921 | Draney | 106/281 R X |
| 1,662,377 | 3/1928 | Downard | 106/281 R X |
| 1,685,304 | 9/1928 | West | 106/208 |
| 1,750,443 | 3/1930 | Tullis | 404/79 |
| 1,758,913 | 5/1930 | Sadtler | 404/81 |
| 1,894,630 | 1/1933 | Neuberger | 106/280 |
| 1,925,282 | 9/1933 | Robinson | 117/21 |
| 1,954,997 | 4/1934 | Hirzel | 106/281 R X |
| 1,999,178 | 4/1935 | Baskin | 106/280 |
| 2,062,348 | 12/1936 | Baskin | 106/281 R X |
| 2,068,164 | 1/1937 | Cadwell | 117/27 |
| 2,104,411 | 1/1938 | Baskin | 106/281 R X |
| 2,210,348 | 8/1940 | Swope | 117/32 X |
| 2,484,792 | 10/1949 | Mollring | 117/21 X |
| 2,757,100 | 7/1956 | Simril | 117/21 X |
| 2,926,100 | 2/1960 | Weigle et al. | 117/21 X |
| 2,978,351 | 4/1961 | Pullar | 117/100 S X |
| 3,132,964 | 5/1964 | Young | 117/32 X |
| 3,249,452 | 5/1966 | Plumb | 106/281 R |
| 3,326,366 | 6/1967 | Butterfield et al. | 117/32 X |
| 3,385,722 | 5/1968 | Weaver et al. | 117/21 X |
| 3,783,000 | 1/1974 | Takase | 117/21 |
| R17,985 | 3/1931 | Radcliffe | 404/79 X |

FOREIGN PATENTS OR APPLICATIONS

| | | | |
|---|---|---|---|
| 3,015 | 6/1871 | United Kingdom | 106/281 R |
| 944,346 | 12/1963 | United Kingdom | 404/82 |
| 22,201 | 11/1895 | United Kingdom | 404/82 |

*Primary Examiner*—Harry J. Gwinnell
*Assistant Examiner*—Shrive P. Beck
*Attorney, Agent, or Firm*—Wenderoth, Lind & Ponack

[57] ABSTRACT

Surfaces of roads, bridges, floors, etc., are easily paved by using a mixture of at least one of granular, powdery and flaky asphalt material and a suitable paving aggregate and applying heat and press thereto at the working site.

6 Claims, No Drawings

METHOD FOR PAVING SURFACES WITH GRANULAR, FLAKY OR POWDERY ASPHALT

CROSS REFERENCE TO RELATED APPLICATION

This application is a continuation-in-part of our copending application, Ser. No. 151,571, filed June 9, 1971, now U.S. Pat. 3,783,000.

FIELD OF THE INVENTION

This invention relates to an easy paving method for roads, bridges, floors, etc., by using a granular, powdery or flaky asphalt material mixed with crushed stone, gravel, sand or other aggregate.

DESCRIPTION OF PRIOR ART

In order to obtain a heated asphalt mixture used for road pavement, etc., the following process has been employed: After the previously melted straight-run asphalt and the dried crushed stone, gravel, sand or other aggregate are mixed at the specified ratio in the heating mixer, this heated asphalt mixture is carried to the working site for paving, its heat being retained in transit. The process for obtaining the heated asphalt mixture is conducted in an asphalt paving plant, which consists chiefly of aggregate heating and drying furnace, asphalt melting kiln, melted asphalt storage tank, scales, conveyor, heating mixer, etc. In general, the melted straight-run asphalt is carried into a storage tank with a large scale heater by means of tank lorries. As its heat must be retained until completion of the paving work, considerable labor and cost are required for exercise of thermal control. In addition, special equipment is required for weighing the melted asphalt, and for supply to the mixer. As a large-scale plant is required for obtaining the heated mixture, movement and laying of the facilities are not easy. Transportation of the heated mixture is limited by traffic conditions. Furthermore, measures must be taken to insure heat retention and to protect against effects of rainfall. At present, with the concern over problems of such environmental pollution hazards as smoke, offensive smell, dust, etc., distance to the working site is also limited. Thus heated asphalt is accompanied by various difficulties and dangers. Especially at low temperatures in cold areas, or in winter, many difficulties must be overcome. Also, conveyance of melted asphalt by tank lorries presents many problems.

In case blowing asphalt is mixed with straight-run asphalt, as may be required for floor pavement of warehouses, etc., to develop pressure resistance, lump melting kilns must be laid on the working site since it is difficult to carry the blowing asphalt by tank lorries. In this connection more equipment, labor and cost are required, and the danger of ignition and firing is increased.

SUMMARY OF THE INVENTION

According to the present invention, however, the required asphalt mixture for paving work can be easily obtained, by using any granular, powdery or flaky asphalt, for example, granular, powdery or flaky straight-run asphalt, blowing asphalt, rubberized asphalt, or mixtures thereof. Thus, any conventional aggregate material, for example, crushed stone, gravel, sand or blended mixtures thereof in specified ratios and quantities, are mixed with at least one of the granular, powdery or flaky asphalt material on the working site to obtain the asphalt mixture. In accordance with the desired road width, roll width of roller, pavement thickness and number of layers, mixtures are then laid in the required width, length and thickness. Thereafter, the road is paved using a rolling press of required frequency.

DETAILED DESCRIPTION OF THE INVENTION

The granular and powdery asphalts used in the method of the present invention can be prepared by employing the apparatus invented by Yoshio Ushiku and Hirokazu Saitoh (the U.S. Patent application Serial No. 148,813 entitled CRUSHER FOR TENACIOUS MATERIAL SUCH AS ASPHALT), filed June 1, 1971, now USP at 3,758,035. The flaky asphalt can be obtained by rolling the powdery asphalt between a pair of rollers. The powdery or granular asphalt wherein the diameter of the granules is from about 0.074 to about 10 mm is preferable. The flaky asphalt wherein the flakes are from about 0.3 to about 0.5 mm thick and from abcut 2 to about 4 mm wide and long is preferable.

The asphalts which can be used in the present invention include straight-run asphalt, blowing asphalt, rubberized asphalt, and cutback asphalt.

Various compounding designs can be easily made, and various physical properties required for the pavement material such as the coarseness, fineness, elasticity, water-tightness, corrosion resistance, durability, etc., can be chosen. Mixtures can be jointly used to achieve these desired objects easily. In enhancing the corrosion resistance and non-slip property, for instance, rubberized asphalt can be employed as the granular, powdery or flaky asphalt material. In improving the water-tightness, the compounding ratios of these materials can be increased. In increasing the pressure resistance, blowing asphalt can be added. Thus, according to the particular object, various materials and their compounding ratios can be thus employed, and the compounded mixture can be easily obtained. Such factors are readily ascertainable by those in the art.

Each asphalt mixture can be weighed and mixed on the working site. The most efficient method, however, is that only the required quantity of each component of the mixture should be weighed previously to effect the desired compounding ratio in compliance with the working conditions, which are then carried to the working site.

At the working site, sufficient press is required for the paving work. As for the heating, the materials are sufficiently heated by the heating roller so that the granular, powdery or flaky asphalt material is softened and fastened. Depending on the working site and conditions, a burner, or burner and roller can be used.

According to this invention, unlike the conventional methods, no tank lorry is required, and large scale machine equipment such as the melting kilns, storage tanks, melted material weighing machines for the melted materials, hot firing furnaces, etc., are not necessary. As a result, plant equipment can be simplified, no large fire is required, production control becomes easy and the number of personnel required can be curtailed.

Various paving methods for roads, bridges, floors of factories, warehouses, etc., and the like using the method of the present invention are illustrated below.

There are three major paving methods, asphalt macadamix method, gussasphalt method and salviecim method.

Asphalt macadamix method, which has been developed in Japan, is a paving method comprising piling three asphalt mixtures which are obtained by mixing coarse aggregate, fine aggregate (limestone powder), dense aggregate (sand), and molten asphalt and in different sizes and mixing ratios of aggregate. In the method, a soft straight-run asphalt is used.

In the present invention, dried aggregate such as gravel, limestone powder, and sand is mixed with powdery straight-run asphalt having penetration of about 60–80 by using a conventional mixer at the working site to obtain the asphalt mixture, in which the powdery straight-run asphalt has adhered to the surface of the aggregate. After the asphalt mixture has been spread or while spreading over the surface to be paved, it is pressed with heating at a temperature of 150°–200°C using a gas burner or an electric heating roller. Since the powdery straight-run asphalt easily melts by heating slightly to increase fluidity and adhesiveness immediately, it covers the surface of the aggregate, forms the asphalt film while proceeding toward total binding and binds the aggregate tightly to each other to form a united paved surface.

As a result, according to the method of the present invention, it is not necessary to use a large scale plant. And the asphalt mixture can easily be obtained by carrying powdery straight-run asphalt, aggregate, etc., to the working site and setting up an apparatus such as a mixer, scales, hopper, etc., heating the aggregate at a temperature of 150°–200°C, supplying a mixer with the powdery straight-run asphalt. Alternatively previously the powdery straight-run asphalt and the dried aggregate at the specified ratio are mixed at normal temperature, i.e. ambient temperature, in a plant or other place, and then this asphalt mixture is carried to the working site using a water-tight vessel and is pressed with heating.

Gussasphalt method is a method comprising flowing a mixture of aggregate and straight-run asphalt, the composition of which varies depending on the object of use, using the fluidity of the mixture at high temperature, to the surface to be paved, and flatening the mixture using a gussasphalt finisher or a trowel. Since comparatively uniform density of paving can be obtained irrespective of the irregular surface to be paved, this method is widely used.

According to the conventional methods, since an asphalt mixture must be treated with higher temperature than that used in other methods in order to obtain a flowable mixture, it is necessary to use enlarged heating apparatus for heating aggregate, limestone powder, etc., and to use a special tank lorry equipped with heating apparatus to maintain the high temperature during transportation. Further disadvatage of the conventional methods is that the paving speed is slow which makes total cost very expensive.

On the contrary, according to the method of the present invention, the disadvatages of the conventional methods mentioned above can completely be overcome. Since the powdery straight-run asphalt used in the present method can be easily melted by slight heating, the uniform asphalt mixture for paving work, with high fluidity can easily be obtained by mixing with stirring, for example, suitable aggregate heated instantly and efficiently with powdery straightrun asphalt, having penetration of 40 – 60, using an ordinary heating drier for the aggregate and a heating mixer at the working site. The thus obtained highly heated flowable mixture is spread over the surface to be paved, flattened using a gussasphalt finisher to obtain excellent pavement efficiently. Since the heated mixture contains about 25% of limestone powder, which is a feature of the gussasphalt method, and a large amount of filler asphalt, void volume produced is extremely little. Therefore, the obtained paved surface is excellent in resistance to water permeability and to weathering and in durability, as well as good in resistance to vibration and impact due to frequent live loads at low temperatures, and to crack. These excellent properties are due to the cohesive force of the filler asphalt used in the present method. When non-slip surface is desired, it is easily obtained by spreading chips (hard sandstone) on the surface or forming an uneven surface during the paving work.

Thus, according to the present invention, it is not necessary to use enlarged heating apparatus or a special tank lorry equipped with heating apparatus. In the present invention, as no long-time heating is required, no thermal decomposition nor denaturing of the material takes place and fresh material can immediately or continuously be supplied. Further advantages of the present method are that the paving speed is fast and that the durability is increased which makes the total cost very cheap.

Salviecim method is a method comprising pouring a special grout containing cement as a major component into voids among aggregate of open asphalt concrete and solidifying it to render asphalt paving rigid. This method is also called a semi-rigid paving method.

In applying this method to the method of the present invention, the open asphalt concrete can easily be prepared by mixing powdery straight-run asphalt having penetration of 60 – 80 with suitable aggregate conventionally used for heat-mixing using a similar method described in the above-mentioned macadamix method. As a grout, cement milk is prepared by mixing, for example, portland cement with fly ash containing 35% of silica having the specific gravity of 2.0 and passing sieve opening of 0.074 mm over 70%. The cement milk is poured into voids of the open asphalt concrete to easily obtain the paved surface having good stability, high water-tight property, excellent oil resistance, incombustibility and good heat resisting property. The thus obtained paved surface is suitable not only for parking places but also for highway ramps, roads near toll-gates and roads in tunnels.

Rubberized asphalt is widely used although more expensive than straight-run asphalt because it has stronger adhesion, cohesion and tackiness than straight-run asphalt, and it has excellent properties at low temperatures, a low tendency to flow or to flash during high temperatures of summer season, and the like.

According to a conventional method, rubberized asphalt is prepared by roll-mixing molten straight-run asphalt with a latex of natural or synthetic rubber at the desired ratio to produce a master batch, and heating the master batch at a temperature of 120° – 160°C. Because of high viscosity of the molten rubberized asphalt, it is necessary to raise the mixing temperature and the rolling temperature by 10° – 20°C higher and to elongate the mixing time longer than those needed for straight-run asphalt. These high temperature treatments inevitably make the rubber component denatured, deteriorated or decomposed. Therefore it is very difficult to obtain uniform rubberized asphalt paving.

It has been proposed to spray a rubber latex on a heated mixture of straight-run asphalt and aggregate in a large scale heating mixer, but this method can not apply to a practical use.

On the contrary, according to the method of the present invention, such defects of the conventional method as mentioned above can completely be overcome. Rubberized asphalt can easily be obtained either by rollmixing powdery asphalt with powdery rubber and heating the product or by spraying a rubber latex on powdery asphalt with stirring at normal temperature and then heating the product. The rubberized asphalt is mixed with aggregate by heating at the working site. The thus obtained rubberized asphalt mixture is spread over the surface to be paved and pressed with heating at 160° – 120°C to obtain uniform rubberized asphalt pavement having excellent physical properties such as durability.

The method of the present invention is more advatageous than paving methods at normal temperature using a rubberized asphalt emulsion or cut-back rubberized asphalt.

The method of the present invention is also advantageously useful for thin layer paving, which is applied to top layer pavement of roads, abrasion resistant pavement, non-slip pavement, bridge slab pavement and the like. The conventional thin layer paving method requires particularly specific type of aggregate. For instance, in order to obtain an abrasion resistant layer, the conventional method requires, as aggregate, hard stones such as Emery, Silica and the like which are excellent in abrasion resisting properties, and therefore there are troublesome problems in operation of a large scale plant and transportation of the material. On the contrary, according to the present invention, since it is possible to use any kind and any quality of aggregate, it is not necessary to use a large scale plant and to transport the heated mixture with a high temperature. Every operation can be done at the working site. For instance, a very good result was obtained by using, as aggregate, the natural material Silica of which MOHS is 7 and abrasion is less than 15% by the Los Angeles test.

In paving the surface of a bridge, a base of which is constituted by Ferro-Concrete Slab, Steel deck plate, Precast concrete Slab, or the like, it is necessary to render the bridge surface excellent in water proofing, durability, non-slip, flatness, and the like properties. Since the working site on the bridge is so narrow and limited, transportation and collection of the paving materials and means are considerably limited, which makes mechanized paving practically impossible.

According to the method of the present invention, however, the paving of bridge surfaces can easily be accomplished by spreading the powdery asphalt mixture for paving work over the base and pressing it with heating, or by mixing heated aggregate with powdery asphalt in a mixer, spreading the mixture over the base and pressing it. The paving work can be accomplished so rapidly that difficulties and dangers of the conventional method are completely overcome.

When the present method is employed, the efficiency in large-scale pavement work will become evident. Further, the effective and prompt effects in repairing damaged points (cracks, subsidences, etc.) scattered over the road surface, which cause difficulties to motorists, are also apparent.

The following examples are presented by way of illustration only, and are not intended to limit the invention.

EXAMPLE 1

This is a method for paving a top surface of 3–4 cm thickness on top of a road foundation which has been previously cementstability treated (to a depth of 12 cm from the top of the gravel layer) on an existing 20 cm thick gravel road bed.

Rapid curing type cut-back asphalt (RC-1) is spread at the rate of one liter/m² on the road foundation. After drying, it is paved with the paving mixture of aggregate and asphalt indicated in Table 1 below.

At the working site, macadam, macadam screenings and river sand were charged into the mixer in the proportion indicated in Table 1. Next, powdery asphalt were added and mixed. Thus, the limestone which had been previously dispersed in the asphalt was also mixed to make the blending complete.

Next, approximately one-third of the complete paving mixture is spread on top of the road foundation and, while heating with a propane gas flame, it is pressed with about a 6-ton asphalt finisher. This is repeated three times to obtain a 3–4 cm thick pavement suitable for light traffic roads, side walks and school ground surfacing.

Table 1

| | | Size | Blend Ratio |
|---|---|---|---|
| Aggregate | Macadam | 5–2 mm | 30% |
| | Macadam screenings | Sieve 2.5 mm pass | 33% |
| | River sand | 0.074 mm stop | 30% |
| | Limestone powder | Sieve 0.074 mm pass | 7% |
| Paving Grade Asphalt | | | 8% |
| Properties of the Paving Grade Asphalt | | | |
| Penetration degree (25°C, 100g, 5 sec) | | | 40–60 |
| Softening Point (Ring & Ball) | | | 60°C |
| Ductility (15°C Dow's Method) | | | 100 |
| Size of Powdery asphalt | | | Diam. 0.2–2mm |

EXAMPLE 2

Pre-treatment is effected by spreading RC-1 (penetration degree 100) at the rate of approximately one liter/m² on top of a road foundation which has been formed in accordance with the design specifications for 20,000 cars per day automobile in traffic.

Next, a 6 cm thickness coarse graded pavement is laid as indicated in Table 2. Namely, with the exception of the limestone in the aggregate, the designated volumes of macadam and river sand (fine aggregate) are charged into the mixer in accordance with the proportion shown in column (1) of Table 2, and a few percent of RC-1 is added to the aggregate and mixing is carried out to cause the asphalt to adhere to the surface of the aggregates. After the solvent has evaporated, the powdery asphalt (paving grade asphalt) indicated in Table 3 is added in the ratio shown, and mixed. Thus, the limestone which has been previously dispersed in the powdery, granular paving asphalt is also added at the same time, which results in a coarse-graded paving mixture having a complete blend as indicated in the Tables.

This paving mixture is spread on top of the road foundation in several passes to obtain the total thickness of the pavement desired. The paving mixture is heated with a propane gas flame maintained at an approximate temperature of 160°C at the tip and pressed with a 15–16 ton roller. RC-1 is spread at the rate of 0.5 liter/m² on top of this 6 cm coarse-graded pavement and after drying, the fine-graded pavement indicated in column (2) of Table 2 is laid to a thickness of 4 cm in the same manner as in column (1) to obtain the desired 10 cm thickness highway pavement.

Table 2

| | Sieve Data | | (1) Coarse-Graded | (2) Fine-Graded |
|---|---|---|---|---|
| | 13 mm sieve-pass | 10 mm sieve-stop | 10% | — |
| Macadam | 10 mm sieve-pass | 5 mm sieve-stop | 30 | 20% |
| | 5 mm sieve-pass | 2.5 mm sieve-stop | 22 | 22 |
| | 2.5 mm sieve-pass | 0.6 mm sieve-stop | 15 | 23 |
| | 0.6 mm sieve-pass | 0.3 mm sieve-stop | 6 | 8 |
| River sand | | | | |
| | 0.3 mm sieve-pass | 0.15 mm sieve-stop | 5 | 9 |
| | 0.15 mm sieve-pass | 0.074 mm sieve-stop | 4 | 8 |
| Limestone | 0.074 mm sieve-pass | — | 8 | 10 |

Table 3

| | Paving Grade Ashpahlt | Volume added to aggregate 6% | Volume added to aggregate 8% |
|---|---|---|---|
| Properties | Penetration degree (25°C, 100g, 5sec) | 60–80 | 40–60 |
| | Softening Point (Ring & Ball) | 40°–55°C | 45°–60°C |
| | Ductility (25°C, Dow's Method) | >100 | >100 |
| | Flaky (size) | Thickness approx 0.5 mm Size 2–4 mm | — |
| | Powdery (size) | — | Diam. 0.5–2 mm |

Note:
Limestone has been previously included in the powdery, granular or flaky asphalt.

EXAMPLE 3

This is related to paving a bridge or highway on girders handling 20,000 cars per day.

RC-1 is spread over the precast concrete slabs erected in accordance with the design specifications in the same manner as in Example 2, and after drying, a 5 cm thick pavement was constructed having non-slip and anti-wear properties by conducting the same operation as indicated in Example 2 in accordance with the blend indicated in column (2) of Table 2.

However, in this case the asphalt to be used is the powdery rubberized asphalt indicated in the Table 4 below.

Table 4

| | |
|---|---|
| Rubberized Asphalt (containing 5% synthetic rubber) | |
| Penetration degree (25°C, 100g, 5 sec) | 80 |
| Softening Point (Ring & Ball Method) | 52°C |
| Ductility (10°C, Dow's Method) | >100 |
| Powdery (size) (containing the designated proportion of limestone) | Diam. 0.5–2 mm |

EXAMPLE 4

This is a method for paving a road using an improved asphalt macadamix method.

To a mixture of sufficiently dried aggregate as shown in Table 5, powdery straight-run asphalt having penetration(25°C, 100g, 5 sec.) of 60 – 80, a softening point of 52°c (Ring and Ball method), ductility(15°C, Dow's method) of above 100 and particle size of 0.2 - 2mm was added and mixed at normal temperature in a mixer to obtain a mixture of aggregate adhering and powdery straight-run asphalt adhering on the surface thereof. Over a road foundation, which has been previously cement-stability treated (to a depth of 12 cm from the top of the gravel layer), on an exising 20 cm thick gravel road bed, RC-1 was spread at the rate of one liter/m² and dried. The paving mixture of aggregate and asphalt mentioned above is then spread thereover at the rate of 35 kg/m², and is pressed with a electric heating roller (surface temperature 180° – 200°C). Successively it was pressed with a macadam roller to obtain one layer. After that, the same amount of the paving mixture was spread thereover again and similarly pressed with the electric heating roller and the macadam roller to obtain a 3 cm thick pavement.

Table 5

| Aggregate | | Sieve Data | | Blend ratio(%) |
|---|---|---|---|---|
| Coarse aggregate | Macadam | 5 mm pass | 2.5 mm stop | 30 |
| Fine aggregate | Macadam | 2.5 mm pass | 0.074 mm stop | 33 |
| Fine aggregate | River sand | 2.5 mm pass | 0.074 mm stop | 30 |
| Filler | limestone | 0.074 mm pass | | 7 |

Table 5-continued

| Aggregate | Sieve Data | Blend ratio(%) |
|---|---|---|
| | powder | |

In the next place, heated aggregate was mixed with powdery straight-run asphalt to obtain the paving mixture.

The aggregate as shown in Table 5 was heated with a burner to 170° – 180°C in a drier. The heated aggregate was then mixed with powdery straight-run asphalt in a small mixer having capacity of 200 kg for 30 sec. to obtain the heated paving mixture wherein the aggregate was covered with the stright-run asphalt on the surface. Over the surface pretreated with RC-1, the heated paving mixture was spread at the rate of 75 kg/m² and was pressed with a macadam roller for 2 – 3 times to obtain a 3 cm thick pavement suitable for light traffic roads, sidewalls and school ground surfacing.

In paving a large area continuously, it is effective to spread the heated paving mixture using an asphalt finisher before pressing.

According to a conventional macadam or macadamix method, only straight-run asphalt having penetration of above 100 is used, whereas in the method of the present invention, straight-run asphalt having penetration of 60 – 80 or 40 – 60 can be successfully. Therefore, according to the method of the present invention, the paved surface having excellent resistance to great temperature change through the seasons can easily be obtained.

EXAMPLE 5

This example relates to application of the method of the present invention to the gussasphalt method.

Table 6

| Aggregate | | Sieve data | Blend ratio(%) |
|---|---|---|---|
| Coarse aggregate | Macadam | 10 mm pass 5 mm stop | 23 |
| Fine aggregate | Macadam | 5 mm pass 2.5 mm stop | 23 |
| Fine aggregate | River sand | 2.5 mm pass 0.074 mm stop | 21 |
| Filler | Limestone powder | 0.074 mm | 33 |

The aggregate as shown in Table 6 was heated with a burner to 210° – 220°C in a drier. The heated aggregate was then mixed with powdery straight-run asphalt having penetration (25°C, 100g, 5 sec) of 20 – 40, a softening point of 62°C (Ring and Ball method), ductility (25°C, Dow's method) of above 50 and particle size of 0.1–1 mm in the proportion of 9% by weight in a mixer for 30 sec. to obtain the flowable heated paving mixture. RC-1 was spread at the rate of 0.5 liter/m² over reinforced concrete slabs and dried. The heated paving mixture was poured on the RC-1 surface using a gussasphalt finisher to obtain the paved surface.

Since the heated paving mixture contains a large amount of limestone powder and filler asphalt, the obtained paved surface shows excellent resistance to permeability due to little volume of voids, resistance to aging, durability, resistance to vibration at low temperatures due to repeated weighing, resistance to repeated impact, resistance to cracking, and the like.

When a mixture obtained by coating hard sandstone particles having 3 – 5 mm particle size with powdery asphalt in the proportion of 0.8% by weight was spread at the rate of 6 kg/m² on the top surface using a chip spreader to obtain 4 cm thick pavement, the obtained paved surface showed extremely excellent non-slip property. Excellent non-slip property can also be obtained by making the paving surface uneven using a spike roller.

As mentioned above, this method does not require long heating time which prevents the asphalt from deterioration and is suitable for paving roads in cold places, bridges, and for repairing damaged points.

EXAMPLE 6

This example relates to application of the method of the present invention to the salviecim method.

Table 7

| Aggregate | | Sieve data (passing %) | |
|---|---|---|---|
| Coarse aggregate | (Macadam) | 20 mm | 100 |
| | | 15 | 87 |
| | | 10 | 45 |
| | | 5 | 25 |
| Fine aggregate | (River sand) | 2.5 mm | 17 |
| | | 0.3 | 6 |
| Filler | {Limestone powder} | 0.074 mm | 3 |

To the aggregate as shown in Table 7 heated to 160° – 180°C, powdery straight-run asphalt having penetration (25°C, 100g, 5 sec.) of 60 – 80, a softening point of 55°C (Ring and Ball method), ductility (15°C, Dow's method) of above 100 and particle size of 0.2 – 2 mm was added in the proportion of 4% by weight and mixed for 40 sec. in a heating mixer. The thus obtained heated mixture was spread over the surface to be paved, which has been previously treated with RC-1 at the rate of one liter/m² and dried, at the rate of 60 kg/m² and was pressed with a roller to obtain a 3 cm thick open grade asphalt concrete layer having a porosity of about 20%. Then the cement milk consisting of 36% by weight of portland cement, 4% of fly ash (specific gravity 2.0, silica content 30% by weight, particle size 0.074 mm pass 70%), 4% of additives such as a polyvinyl acetate emulsion, and 36% of water mixed for 5 minutes was spread over the open grade asphalt concrete layer cooled to the ambient temperature and was compressed using a vibrating roller. After standing 5 – 6 days, as it was, the thus paved road was opened to traffic. The pavement showed great rigidity, stability, and water-tight property. This method is suitable for paving a parking place, a highway and the like. It is important to control the porosity of an open grade asphalt layer.

Example 7

This example relates to the production of rubberized asphalt and its use for paving.

Powdery straight-run asphalt having properties as shown in Table 8 (100 parts by weight) was mixed with 5 parts by weight of powdery natural rubber (50 mesh) at 130°C for 30 minutes in a mixer. The straight-run asphalt melted rapidly and the dispersion and fusion of the rubber was accelerated. To the thus obtained rubberized asphalt, the aggregate as shown in Table 6 heated to 160° –180°C was added and mixed with stirring for 50 sec. to obtain a heated mixture of rubberized asphalt and aggregate coated with rubberized asphalt. By pressing the heated mixture on the surface to be paved, the aggregate coated with rubberized asphalt approached one another and the gaps among the aggregate were filled and bound with rubberized asphalt and fine aggregate combined therewith. The obtained pavement was excellent in water-tightness, resistances to vibration, to impact, to cracking and to abrasion.

Table 8

| | Powdery straight-run asphalt (diam., 0.5 – 2 mm)100 | Rubberized straight asphalt |
|---|---|---|
| Penetration(25°C, 100 g, 5 sec.) | 87 | 80 |
| Softening point(Ring and Ball) method) | 49°C | 52°C |
| Ductility(5°C, Dow's method) | 8 | >100 |
| | Powdery Natural Rubber (50 mesh) 5 | |

In the next place, 100 parts by weight of powdery straight-run asphalt was stirred at normal temperature in a mixer and 10 parts by weight of synthetic rubber (SBR) latex was sprayed thereon to obtain the powdery straight-run asphalt coated with a thin film of SBR. The paving mixture was prepared either by blending the powdery straight-run asphalt coated with SBR in a heating mixer to obtain rubberized asphalt, which was mixed with heated aggregate for 50 sec., or by mixing, with heating the powdery straight-run asphalt coated with SBR with heated aggregate in a heating mixer. The paving mixture was spread over the surface to be paved and pressed to complete paving.

Since deterioration of the rubber can be prevented by short time mixing according to this method, adhesion between each aggregate is strong, the paved surface shows great coefficient of friction, non-slip effect, stability which results in almost no softening or rippling at high temperatures in summer and almost no cracking or tearing at low temperatures in winter, and good durability.

EXAMPLE 8

This example relates to a thin layer paving excellent in resistance to abration and non-slip property.

Table 9

| Aggregate | Sieve data | Blend ratio(%) |
|---|---|---|
| Silica sand | 1.2 mm pass 0.6 mm stop | 66.7 |
| Silica Sand | 0.15 mm pass 0.074 mm stop | 23.1 |

Table 9-continued

| Aggregate | Sieve data | Blend ratio(%) |
|---|---|---|
| Limestone powder | 0.074 mm pass | 10.2 |

Note)
Silica sand is MOHS 7, abrasion 15% by he Los Angeles abrasion test.

The aggregate as shown in Table 9 heated to 170° – 180°C with a burner in a drier was mixed with the rubberized asphalt obtained in Example 7 in the proportion of 8% by weight based on the weight of the aggregate in a heating mixer for 40 sec. The resulting heated mixture was spread over the base, which was previously treated with RC-1 by spreading at the rate of one liter/m² and drying, at the rate of 50 kg/m² and was pressed with an asphalt finisher and pressed twice with a roller to obtain a 2 cm thick layer pavement. The pavement was excellent in non-slip property, durability, water-proofing property, and the like and is suitable for paving roads with heavy traffic and bridge.

EXAMPLE 9

This example relates to repairing cracks, voids, or the like on the surface of a road, bridge, or the like.

A void in the form of an ellipse of 50 cm in the longer diameter, 40 cm in the shorter diameter and 5 cm in depth produced on the surface of a road comprising a 8 cm thick surface layer of a mixture of asphalt and fine grade aggregate as shown in Table 2 and a 20 cm thick base layer of a mixture of asphalt and coarse grade aggregate as shown in Table 2, was repaired as follows: About 10 liters of a paving mixture was prepared by mixing 100 parts by weight of dried fine grade aggregate with 6 parts by weight of powdery catalytic air blowing asphalt having penetration (25°C, 100 g, 5 sec.) of 35 – 45, a softening point of 95°C (Ring and Ball method), ductility (0°C, Dow's method) of 2.0 and particle size of 0.2 – 2 mm. After heating the surface of the void with a LPG gas burner, the resulting paving mixture was charged in the void and pressed with a hand roller to complete repairing. It takes about 30 minutes for this repairing work. Since the catalytic air blowing asphalt contains a large amount of a resin component which has great tackiness, the obtained pavement is excellent in resistance to rippling, ductility at low temperatures, stability, durability, resistance to cracking and tearing, and the like.

When a void is small, for example, about half of the above-mentioned void, the paving mixture at ambient temperature may be filled in the void without any heat treatment and pressed with a roller. Pressed by the weight of vehicles such as cars, the repaired surface became as rigid as that obtain by heat and press treatment as mentioned above.

What is claimed is:

1. A method for paving surfaces with asphalt which comprises forming a mixture consisting of (1) powdery or granular asphalt having a diameter of from about 0.074 to about 10 mm or flaky asphalt having a thickness of from about 0.3 to about 0.5 mm and a width and length of from about 2 to about 4mm, said asphalts having a softening point of not greater than 95°C as measured by the Ring and Ball method and a penetration of from 35 to 80 as measured at 25°C, 100 g, 5 sec., and (2) a suitable dried aggregate, the proportion of the asphalt in said mixture being from 4 to 9% by weight, spreading said mixture on the surface to be paved, and pressing the mixture onto said surface.

2. A method according to claim 1, wherein the mixture is heated while said mixture is being pressed onto said surface.

3. A method according to claim 2, wherein the mixing step is carried out at ambient temperature, and the mixture is pressed onto said surface with a roller at a temperature of 150 to 200°C.

4. The method according to claim 1, wherein the asphalt is straight-run asphalt, blown asphalt or a mixture thereof.

5. A method according to claim 1, wherein the asphalt is powdery asphalt having a temperature of ambient temperature and a particle size of 0.1 to 1 mm, the dried aggregate is heated to from 210° to 220°C, and the mixture is flattened onto said surface by means of a gussasphalt finisher or a trowel.

6. A method according to claim 1, wherein the asphalt is mixed with the dried aggregate at ambient temperature, the mixture is spread onto the surface of previously heated voids or cracks, and the mixture is pressed onto said surface by means of a hand roller.

* * * * *